US006951100B2

(12) United States Patent
Kuboshima et al.

(10) Patent No.: US 6,951,100 B2
(45) Date of Patent: Oct. 4, 2005

(54) EXHAUST GAS CLEANING SYSTEM OF INTERNAL COMBUSTION ENGINE

(75) Inventors: Tsukasa Kuboshima, Okazaki (JP); Masumi Kinugawa, Okazaki (JP); Kiyonori Sekiguchi, Okazaki (JP); Makoto Saito, Okazaki (JP); Shigeto Yahata, Obu (JP)

(73) Assignee: Denso Corporation, Kariya (JP)

( * ) Notice: Subject to any disclaimer, the term of this patent is extended or adjusted under 35 U.S.C. 154(b) by 126 days.

(21) Appl. No.: 10/722,569

(22) Filed: Nov. 28, 2003

(65) Prior Publication Data

US 2004/0128987 A1 Jul. 8, 2004

(30) Foreign Application Priority Data

Nov. 28, 2002 (JP) ..... 2002-345463

(51) Int. Cl.[7] ..... F01N 3/02

(52) U.S. Cl. ..... 60/311; 60/274; 60/295; 60/300; 60/278

(58) Field of Search ..... 60/285, 295, 297, 60/300, 311

(56) References Cited

U.S. PATENT DOCUMENTS 4,535,588 A * 8/1985 Sato et al. ..... 60/286
5,908,022 A * 6/1999 Aoki et al. ..... 123/568.16
6,470,850 B1 * 10/2002 Sasaki et al. ..... 123/305
6,594,990 B2 * 7/2003 Kuenstler et al. ..... 60/295
6,598,387 B2 * 7/2003 Carberry et al. ..... 60/297
6,758,037 B2 * 7/2004 Terada et al. ..... 60/295

FOREIGN PATENT DOCUMENTS

JP 2000-170521 6/2000

* cited by examiner

*Primary Examiner*—Thomas Denion
*Assistant Examiner*—Diem Tran
(74) *Attorney, Agent, or Firm*—Nixon & Vanderhye P.C.

(57) ABSTRACT

An electronic control unit (an ECU) detects an operating condition of an engine and quantity of particulate matters accumulated in a diesel particulate filter (a DPF) having an oxidation catalyst from a pressure difference across the DPF. The ECU operates temperature increasing means for regenerating the DPF based on the above detection results. During a low speed and light load operation, the ECU does not perform temperature increasing operation similar to an operation performed during a middle load operation. Instead, the ECU performs operation such as reduction of recirculated exhaust gas quantity in order to inhibit an increase in the quantity of the accumulated particulate matters. When the operating condition is changed afterward, the temperature increasing means is operated, so safe regeneration of the DPF is achieved.

18 Claims, 6 Drawing Sheets

EXHAUST GAS CLEANING SYSTEM OF INTERNAL COMBUSTION ENGINE

CROSS REFERENCE TO RELATED APPLICATION

This application is based on and incorporates herein by reference Japanese Patent Application No. 2002-345463 filed on Nov. 28, 2002.

BACKGROUND OF THE INVENTION

1. Field of the Invention

The present invention relates to an exhaust gas cleaning system having a particulate filter for collecting particulate matters included in exhaust gas of an internal combustion engine.

2. Description of Related Art

Particulate matters discharged from a diesel engine have a great effect on the environment. As a countermeasure to it, conventionally, a diesel particulate filter (a DPF, hereafter) formed of a ceramic porous body is employed, for instance. The DPF is disposed in an exhaust pipe in order to collect the particulate matters at its porous partition walls. The DPF is regenerated by eliminating the collected particulate matters through combustion regularly.

In the regeneration of the DPF, a quantity of the accumulated particulate matters (a PM accumulation quantity m, hereafter) is calculated based on a pressure difference across the DPF. If the PM accumulation quantity m exceeds a predetermined quantity, temperature increasing means is operated to heat the DPF above a certain temperature, at which the particulate matters can be combusted, so the DPF is regenerated. Under some operating conditions of the engine, the temperature of the exhaust gas increases to a high temperature, at which spontaneous combustion of the particulate matters is possible. In order to regenerate the DPF efficiently, the temperature increasing means should be preferably operated in accordance with the operating condition of the engine. A technology of such a kind aiming at regenerating the DPF efficiently is disclosed in Japanese Patent Unexamined Publication No. 2000-170521, for instance.

The above patent document discloses a method for selecting temperature increasing means in accordance with an operating condition of an engine and for regenerating the DPF by increasing the temperature of the DPF with the selected temperature increasing means when the PM accumulation quantity m reaches a predetermined quantity. The operating condition (a load condition) of the engine is classified into a plurality of areas based on engine rotation speed and output torque, for instance. Different kinds of regenerating operations are performed in the respective areas. In an area where the spontaneous combustion of the accumulated particulate matters is possible, no special operation is performed. Thus, the regeneration of the DPF can be performed appropriately while inhibiting an increase in fuel consumption.

However, the method disclosed in the above patent document does not perform the temperature increasing operation in an area where the engine rotation speed is low and a load is light even if the PM accumulation quantity m reaches a quantity at which the regeneration of the DPF is necessary. It is because the temperature increase of the DPF to the temperature enabling the combustion of the particulate matters is difficult in the low speed and light load area. More specifically, in the technology disclosed in the above patent document, the regenerating operation is not performed if the operating condition of the engine is in the low rotation speed and low load area in the case where the PM accumulation quantity m reaches the quantity at which the regeneration is necessary. If the operating condition of the engine enters the low rotation speed and low load area during the regeneration, the regenerating operation is stopped.

However, if the operation of the engine in the low rotation speed and light load area such as an idling operation or an operation in a traffic congestion continues for a long time, a large amount of the particulate matters will be accumulated in the DPF beyond a permissible quantity.

If the PM accumulation quantity m increases, exhaust gas pressure will be increased and an engine output will be degraded. Moreover, reaction heat generated when the large amount of the accumulated particulate matters is combusted rapidly can degrade or damage the DPF and a catalyst. In order to prevent these problems, the permissible value of the PM accumulation quantity m is determined.

Therefore, in the case where the particulate matters greater than the permissible quantity are accumulated, there is a possibility that the engine output may be degraded in the technology disclosed in the above patent document. Moreover, if the operating condition of the engine is changed to a middle load operating condition or a heavy load operating condition afterward, there is a possibility that the large amount of the accumulated particulate matters may be combusted rapidly, and the DPF and the catalyst may be degraded or damaged.

SUMMARY OF THE INVENTION

It is therefore an object of the present invention to provide an exhaust gas cleaning system for an internal combustion engine capable of preventing excessive accumulation of particulate matters in a DPF beyond a permissible quantity. Thus, degradation of an output of the internal combustion engine can be prevented, and degradation or damage of the DPF and a catalyst, which may be caused when the large amount of the particulate matters is combusted rapidly, can be prevented. Thus, a safe and high-performance exhaust gas cleaning system can be provided.

According to an aspect of the present invention, an exhaust gas cleaning system for an internal combustion engine includes a particulate filter, operating condition detecting means, particulate matter accumulation quantity detecting means, temperature increasing means and temperature increase controlling means. The particulate filter is disposed in an exhaust passage of the internal combustion engine for collecting particulate matters included in the exhaust gas. The operating condition detecting means detects an operating condition of the engine. The particulate matter accumulation quantity detecting means detects the quantity of the particulate matters accumulated in the particulate filter. The temperature increasing means increases temperature of the particulate filter. The temperature increase controlling means controls the temperature increasing means based on detection results of the operating condition detecting means and the particulate matter accumulation quantity detecting means. The temperature increase controlling means includes particulate matter accumulation inhibiting means for inhibiting the accumulation of the particulate matters to the particulate filter when the particulate matter accumulation quantity exceeds a predetermined quantity and a predetermined operating condition is established.

Even when the regeneration of the particulate filter is required based on the detection result of the particulate matter accumulation quantity detecting means, the regeneration and the like are not performed in the technology of the related art if the operating condition is changed to a low speed and light load condition in which the temperature increase for the regeneration is difficult. Therefore, there is a possibility that the PM accumulation quantity m may increase further and the particulate filter temperature may increase extremely when the regeneration is performed afterward. On the contrary, the particulate matter accumulation inhibiting means of the exhaust gas cleaning system of the present invention is operated to inhibit the accumulation of the particulate matters under the predetermined operating condition. Therefore, the PM accumulation quantity m is not increased virtually. Therefore, the particulate filter can be regenerated safely by performing the temperature increasing operation with the temperature increase controlling means when the regeneration becomes possible afterward. Thus, degradation of engine performance or degradation of a catalyst can be prevented.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT

Figure 1:
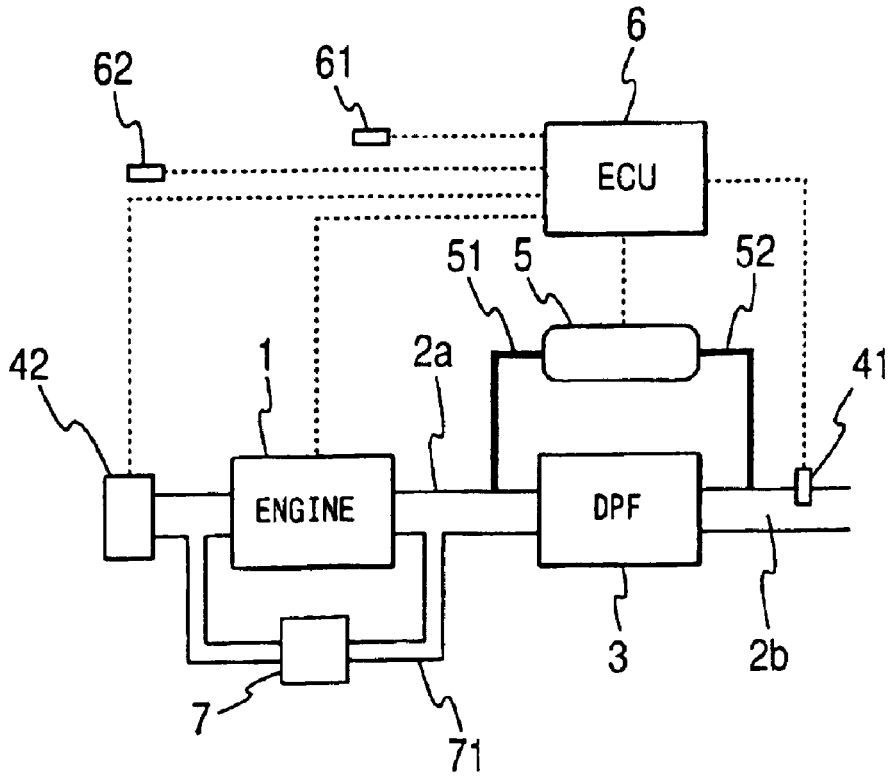
FIG. 1 is a schematic diagram showing an exhaust gas cleaning system of an internal combustion engine according to an embodiment of the present invention.

Referring to FIG. 1, an exhaust gas cleaning system according to the embodiment of the present invention is illustrated. The exhaust gas cleaning system shown in FIG. 1 is applied to a diesel engine 1. In an exhaust passage of the diesel engine 1, a diesel particulate filter 3 applied with an oxidation catalyst on its surface (a DPF 3 having an oxidation catalyst) is disposed between an upstream exhaust pipe 2*a* and a downstream exhaust pipe 2*b*. For instance, the DPF 3 is formed of heat-resistant ceramics such as cordierite in the shape of a honeycomb having a multiplicity of cells as gas passages. An inlet or an outlet of each cell of the DPF 3 is blocked alternately. The oxidation catalyst such as platinum is applied on the surfaces of cell walls of the DPF 3. Exhaust gas discharged from the engine 1 flows downstream while passing through the porous partition walls of the DPF 3. Meanwhile, particulate matters included in the exhaust gas are collected by the partition walls and are gradually accumulated in the DPF 3. The oxidation catalyst is employed in order to perform stable combustion while decreasing the temperature for the regeneration. Alternatively, the DPF 3 having no oxidation catalyst can be employed.

An exhaust gas temperature sensor 41 for sensing the temperature of the DPF 3 is disposed in the downstream exhaust pipe 2*b* downstream of the DPF 3. The exhaust gas temperature sensor 41 is connected to an electronic control unit (an ECU) 6. The exhaust gas temperature sensor 41 senses temperature of the exhaust gas at the outlet of the DPF 3 and outputs the temperature to the ECU 6. An airflow meter (an intake quantity sensor) 42 is disposed in an intake pipe 11 of the engine 1. The airflow meter 42 senses air intake quantity and outputs the intake quantity to the ECU 6. The intake pipe 11 is connected with the upstream exhaust pipe 2*a* upstream of the DPF 3 through an exhaust gas recirculation passage (an EGR passage) 71 having an exhaust gas recirculation valve (an EGR valve) 7. The ECU 6 controls the drive of the EGR valve 7.

A pressure difference sensor 5 is connected to the upstream exhaust pipe 2*a* and the downstream exhaust pipe 2*b* for measuring a quantity of the particulate matters collected and accumulated in the DPF 3 (a PM accumulation quantity m, hereafter) by sensing a pressure difference across the DPF 3. An end of the pressure difference sensor 5 is connected with the upstream exhaust pipe 2*a* upstream of the DPF 3 through a pressure introduction pipe 51. The other end of the pressure difference sensor 5 is connected with the downstream exhaust pipe 2*b* downstream of the DPF 3 through another pressure introduction pipe 52. The pressure difference sensor 5 outputs a signal corresponding to the pressure difference across the DPF 3 to the ECU 6.

Moreover, the ECU 6 is connected with various sensors such as an accelerator position sensor 61 or a rotation speed sensor 62. The ECU 6 calculates optimum fuel injection quantity, injection timing, injection pressure and the like corresponding to the operating condition of the engine, based on detection signals outputted from the various sensors. Thus, the ECU 6 controls the fuel injection to the engine 1. The ECU 6 controls a quantity (an EGR quantity) of the exhaust gas recirculated into intake air by regulating an opening degree of the EGR valve 7.

The ECU 6 controls the regeneration of the DPF 3 so that the PM accumulation quantity m does not exceed a permissible range. Therefore, in the present embodiment, the ECU 6 includes operating condition detecting means for detecting the operating condition of the engine 1 such as engine rotation speed and an accelerator position (or torque, the fuel injection quantity and the like). The ECU 6 includes PM accumulation quantity detecting means for calculating the PM accumulation quantity m based on the pressure difference across the DPF 3 and a flow rate of the exhaust gas flowing through the DPF 3. Alternatively, the PM accumulation quantity detecting means calculates the PM accumulation quantity m in the DPF 3 by accumulating the quantity of the particulate matters (a PM discharge quantity md) discharged from the engine 1 based on an engine operation history. The ECU 6 includes DPF temperature increase controlling means for operating DPF temperature increasing means, which increases the temperature of the DPF 3, based on the detection results of the operating condition detecting means and the PM accumulation quantity detecting means. The DPF temperature increasing means can perform post injection, retardation of the fuel injection timing, restriction of the intake air, or a combination of these methods to increase the temperature of the DPF 3.

Figure 2:
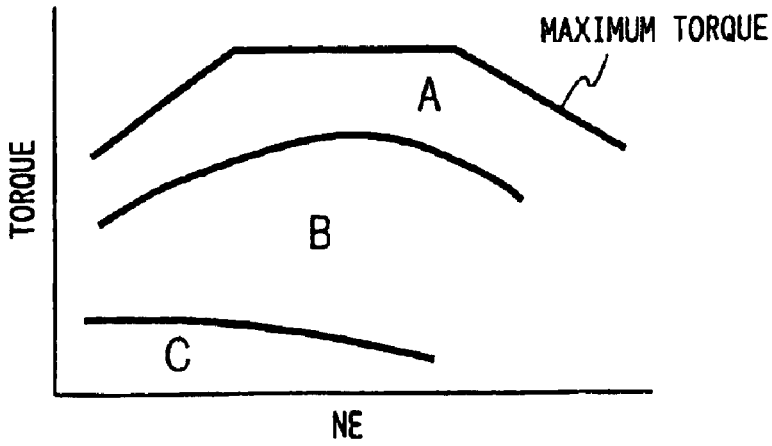
FIG. 2 is a graph showing operating areas of the engine defined based on engine rotation speed and output torque of the engine according to the embodiment.

Next, the temperature increase controlling means will be explained. The temperature increase controlling means operates the DPF temperature increasing means in accordance with the operating condition of the engine 1 when the PM accumulation quantity m in the DPF 3 exceeds a predetermined quantity. The temperature increase controlling means performs an operation for inhibiting the accumulation of the particulate matters in the DPF 3 with PM accumulation inhibiting means when the temperature increasing operation with the DPF temperature increasing means is difficult. More specifically, as shown in FIG. 2, the operation area of the engine 1 is classified into three areas A, B, C, based on the engine rotation speed NE and the output torque of the engine. The area A represents a heavy load operating area of the engine 1. The area B represents a middle load operating area of the engine 1. The area C represents a low speed and light load operating area of the engine 1. More specifically, the operating condition of the engine 1 is determined to be in the area A if the output torque of the engine 1 is equal to or greater than a first threshold, which is determined in accordance with the engine rotation speed NE. The operating condition of the engine 1 is determined to be in the area B if the output torque of the engine 1 is less than the first threshold and is equal to or greater than a second threshold, which is determined in accordance with the engine rotation speed NE and is less than the first threshold. The operating condition of the engine 1 is determined to be in the area C if the output torque of the engine 1 is less than the second threshold.

If the operating condition of the engine 1 is in the area A, the temperature of the exhaust gas is high (for instance, the temperature is beyond 500° C.) and the particulate matters accumulated in the DPF 3 can combust spontaneously. Therefore, no special temperature increasing operation is performed.

If the operating condition of the engine 1 is in the area B, the temperature increasing means is operated in order to regenerate the DPF 3 by combusting the particulate matters accumulated in the DPF 3.

If the operating condition of the engine 1 is in the area C, the temperature increasing means, which is operated in the area B, is not operated. It is because fuel consumption will be greatly increased if the temperature increasing means is operated to heat the DPF 3 to the temperature (for instance, 500° C. or higher) high enough to combust and eliminate the particulate matters when the operating condition of the engine 1 is in the area C.

A large amount of the particulate matters will be accumulated in the DPF 3 if the operating condition of the engine 1 remains in the area C for a long period. In this case, there is a possibility that the particulate matters greater than a permissible quantity may combust rapidly when the operating condition of the engine 1 is brought to the area A afterward, for instance. As a result, a base material of the DPF 3 or the catalyst will be heated to a high temperature (for instance, 800° C. or higher) above a permissible temperature and the DPF 3 or the catalyst may be degraded or damaged. Therefore, in the present embodiment, in order to avoid the above problem, the PM accumulation inhibiting means is operated in order to prevent the increase in the PM accumulation quantity m.

Specifically, the PM accumulation inhibiting means reduces the PM discharge quantity md when the operating condition of the engine is in the area C in order to inhibit the accumulation of the new particulate matters in the DPF 3. As a result, in the case where the operating condition of the engine 1 is brought to the area A or the area B afterward, the particulate matters accumulated in the DPF 3 can be combusted safely. More specifically, the PM accumulation inhibiting means reduces the PM discharge quantity md by decreasing the EGR quantity from a preset value. Alternatively, the PM accumulation inhibiting means reduces an upper limit guard value of the injection quantity with respect to the intake quantity. The upper limit guard value is set in order to inhibit the discharge of the particulate matters. Thus, even when the intake quantity becomes insufficient with respect to the fuel injection quantity (specifically, when the vehicle is accelerated, for instance), the generation of the particulate matters caused by shortage of the air at the engine 1 can be prevented efficiently. As a result, even when the vehicle is traveling in a traffic congestion, in which acceleration and deceleration are repeated at a low speed, the particulate matters accumulated in the DPF 3 can be reduced. The reducing degree of the guard value is set within a range in which accelerating performance (drivability) of the vehicle is not degraded.

Alternatively, fuel injection pressure may be increased or fuel injection timing may be advanced in order to reduce the discharge of the particulate matters. In addition, the increase in the PM accumulation quantity m can be inhibited by gradually combusting the particulate matters accumulated in the DPF 3 specifically, the temperature increasing means is operated in a range, in which the fuel consumption is not degraded greatly, so that the temperature of the DPF 3 is increased to a certain temperature (for instance, 400° C.) lower than the temperature achieved in the operation in the area B. In this method, the particulate matters in the DPF 3 cannot be eliminated quickly through combustion. However, the particulate matters in the DPF 3 are combusted gradually while inhibiting the degradation of the fuel consumption. Therefore, the accumulation of the particulate matters beyond the permissible quantity can be avoided. As a result, when the operating condition of the engine 1 enters the area A or the area B, the particulate matters accumulated in the DPF 3 can be combusted safely.

Under some conditions, the engine emission and the like may be degraded through the above operations. The PM discharge quantity md from the engine 1 is relatively small in the area C. Therefore, the large amount of the particulate matters is not accumulated in the DPF 3 rapidly. Therefore, even when the operating condition of the engine 1 enters the area C, no special operation should be performed immediately. Instead, it should be preferably determined whether duration of the operating condition in the area C is longer than a predetermined period with determining means. The problems of the degradation in the fuel consumption and the rapid combustion of the accumulated particulate matters can be avoided by operating the PM accumulation inhibiting means or the temperature increasing means only when the operating condition in the area C continues for a long period.

Figure 3:
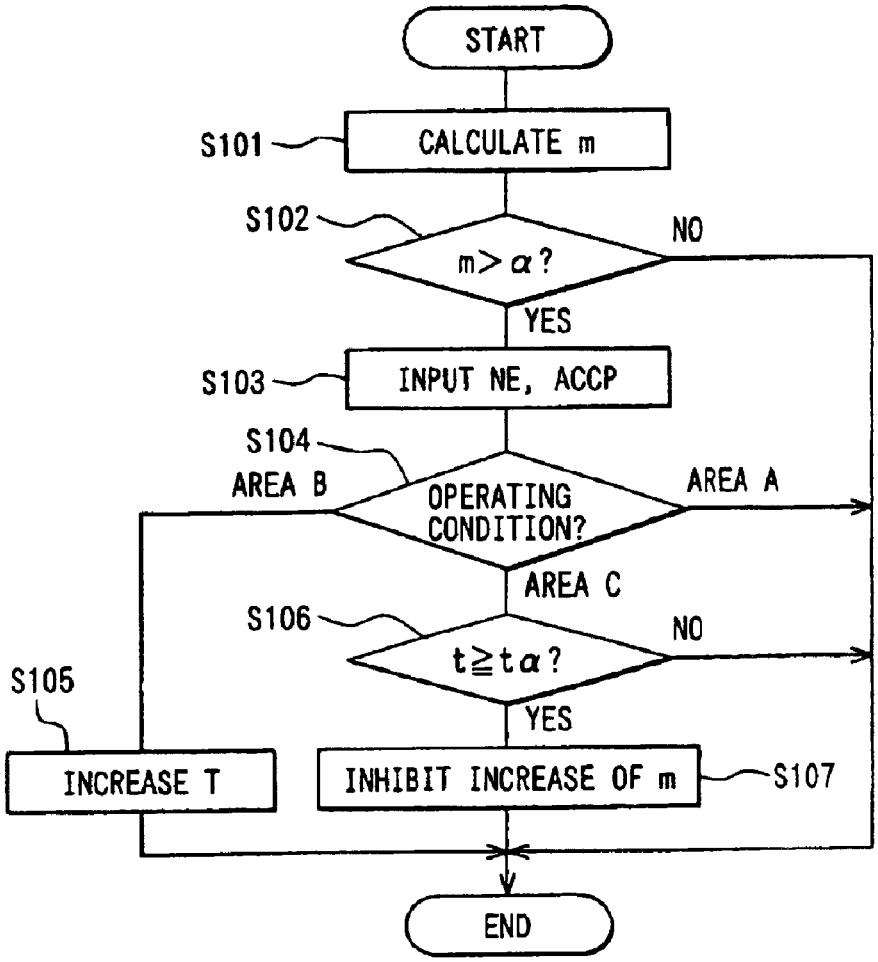
FIG. 3 is a flowchart showing an operation of an electronic control unit of the exhaust gas cleaning system according to the embodiment.

Next, a control routine for the regeneration of the DPF 3 by the ECU 6 will be explained based on a flowchart shown in FIG. 3. The ECU 6 performs the routine at a predetermined interval. In Step S101, the PM accumulation quantity m of the particulate matters accumulated in the DPF 3 is calculated. The PM accumulation quantity m can be calculated from the pressure difference across the DPF 3 sensed by the pressure difference sensor 5, for instance. It is because the pressure difference generated when a predetermined quantity of the exhaust gas passes through the DPF 3 is correlated with the PM accumulation quantity m. The relationship between the pressure difference and the PM accumulation quantity m is calculated through experimentation and the like and is stored in a memory of the ECU 6 as data in advance. The quantity of the exhaust gas is calculated from the intake quantity sensed by the airflow meter 42, the temperature of the DPF 3 (DPF temperature) sensed by an exhaust gas temperature sensor 41, and the like.

Alternatively, the PM accumulation quantity m can be calculated based on the operation history of the engine 1. For instance, the PM discharge quantity md per unit time is calculated from the engine rotation speed NE and the output torque. The PM accumulation quantity m can be calculated by multiplying the PM discharge quantity md per unit time by particulate matter collection efficiency at the DPF 3.

In Step S102, it is determined whether the PM accumulation quantity m calculated in Step S101 reaches a predetermined quantity at which the regeneration of the DPF 3 through the combustion and the elimination of the particulate matters is required. More specifically, it is determined whether the PM accumulation quantity m is greater than a predetermined quantity $\alpha$ or not in Step S102. The predetermined quantity $\alpha$ is determined in advance normally from the perspective of the prevention of the decrease in the engine output and the degradation or the damage of the filter base material and the catalyst. The decrease in the engine output is caused by the increase in the exhaust gas pressure due to the accumulation of the particulate matters in the DPF 3. The degradation or the damage of the filter base material and the catalyst is caused by the reaction heat generated when the large amount of the accumulated particulate matters is combusted at once. If the result of the determination in Step S102 is "NO", it is determined that the regeneration is unnecessary and the control routine is ended once.

If the result of the determination in Step S102 is "YES", the processing proceeds to Step S103 and the engine rotation speed NE and the accelerator position ACCP are inputted from the rotation speed sensor 62 and the accelerator position sensor 61. In Step S104, output torque is calculated from the engine rotation speed NE and the accelerator position ACCP inputted in Step S103, and an area of the present operating condition of the engine 1 is determined and selected from the areas A, B, C, based on FIG. 2. Then, a subsequent operation is selected from different types of operations in accordance with the determined area of the operating condition of the engine 1. If it is determined that the operating condition of the engine 1 is in the area A, the engine 1 is under the heavy load operating condition. In this case, the temperature of the exhaust gas is high and the particulate matters accumulated in the DPF 3 can combust spontaneously. Therefore, no special operation is performed and the control routine is ended once.

If the engine operating condition is determined to be in the area B, the processing proceeds to Step S105 and the temperature increasing operation for regenerating the DPF 3 is performed with the DPF temperature increasing means. The DPF temperature increasing means performs the post injection, the retardation of the fuel injection timing, the restriction of the intake air or a combination of these methods to increase the temperature of the exhaust gas and to perform the oxidation reaction of unburned hydrocarbon on the oxidation catalyst. Thus, the temperature of the DPF 3 is increased to a high temperature (for instance, 500° C. or higher). Thus, the particulate matters accumulated in the DPF 3 are combusted and eliminated, so the collecting ability of the DPF 3 is regenerated.

If the engine operating condition is determined to be in the area C (the low speed and light load operating condition), the processing proceeds to Step S106 and it is determined whether the duration t of the operation in the area C is equal to or longer than a predetermined period ta. If operation in Step S107 (explained after) is performed, there is a possibility that the engine emission and the like may be slightly degraded under some conditions. The PM discharge quantity md from the engine 1 in the area C is relatively small, and the large amount of the particulate matters is not accumulated in the DPF 3 rapidly. Therefore, even if the engine operating condition enters the area C, no special operation is performed immediately. Only in the case where the operating condition in the area C continues for a long time, the operation in Step S107 is performed. The predetermined period t$\alpha$ is set at thirty minutes, for instance. If the result of the determination in Step S106 is "NO", the routine is ended once.

If the result of the determination in Step S106 is "YES", the processing proceeds to Step S107 and operation for inhibiting the increase in the PM accumulation quantity m in the DPF 3 is performed in Step S107. Examples of the operation in Step S107 will be enumerated below.

EXAMPLE 1

Figure 4:
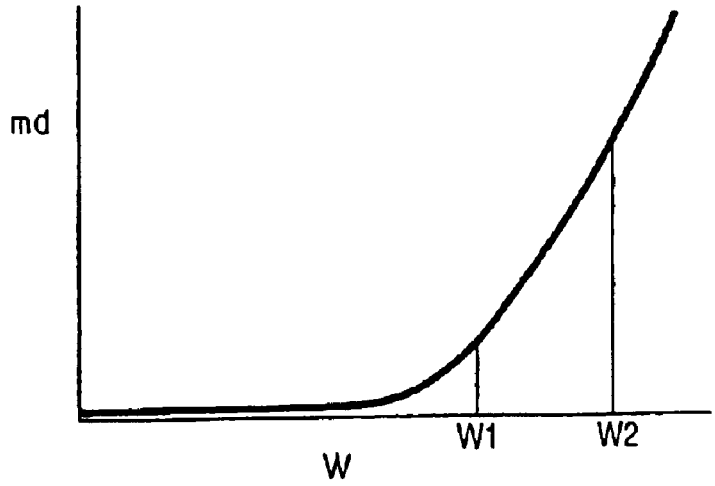
FIG. 4 is a graph showing a relationship between n an exhaust gas recirculation quantity and a particulate matter discharge quantity in a low speed and light load operating area of the engine according to the embodiment.

As shown in FIG. 4, the PM discharge quantity md increases rapidly if the EGR quantity W of the EGR gas recirculated to the intake air through the EGR passage 71 shown in FIG. 1 exceeds a certain value. Therefore, the EGR quantity W is reduced from a preset quantity W2 to another quantity W1, at which the PM discharge quantity md is relatively small, so as to limit the PM discharge quantity md.

EXAMPLE 2

Figure 5:
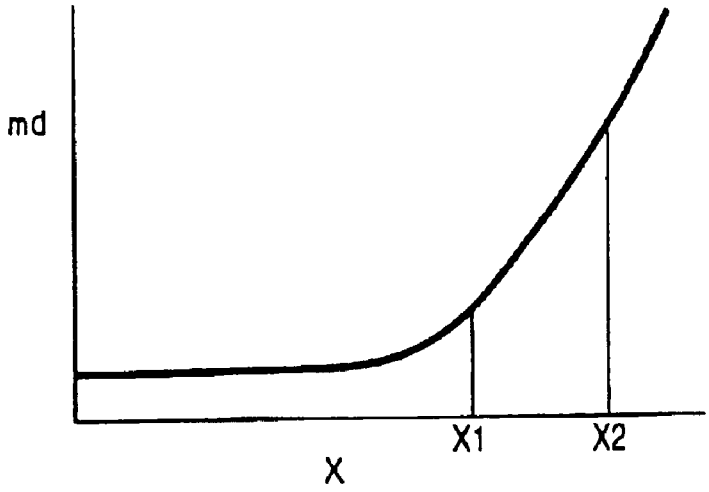
FIG. 5 is a graph showing a relationship between a fuel injection quantity upper limit value and the particulate matter discharge quantity in the low speed and light load operating area of the engine according to the embodiment.

As shown in FIG. 5, the PM discharge quantity md increases rapidly if the fuel injection quantity exceeds a certain value. The generation of the particulate matters is progressed when the quantity of the intake air is insufficient with respect to the fuel quantity. Therefore, the upper limit value X of the fuel injection quantity is reduced from a preset value X2 to another value X1 in order to limit the PM discharge quantity md as shown in FIG. 5. Thus, the generation of the particulate matters can be prevented effectively.

EXAMPLE 3

Figure 6:
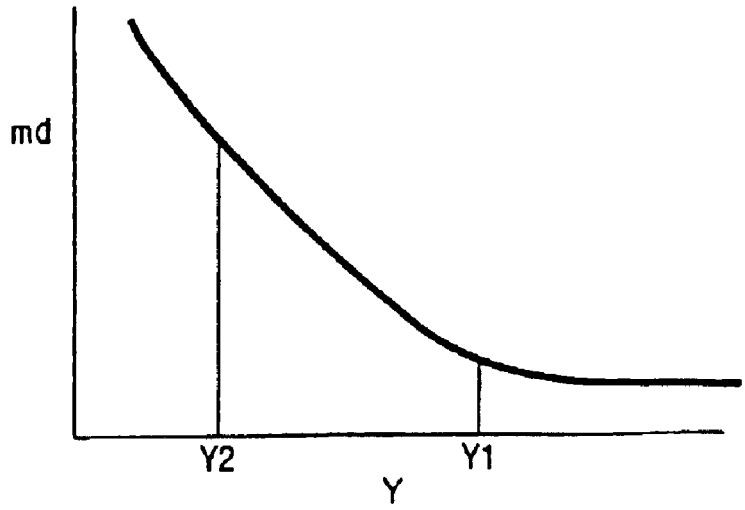
FIG. 6 is a graph showing a relationship between a fuel injection pressure and the particulate matter discharge quantity in the low speed and light load operating area of the engine according to the embodiment.

As shown in FIG. 6, the PM discharge quantity md decreases as the fuel injection pressure Y increases. Therefore, the fuel injection pressure Y is increased from a preset pressure Y2 to another pressure Y1 in order to limit the PM discharge quantity md.

EXAMPLE 4

Figure 7:
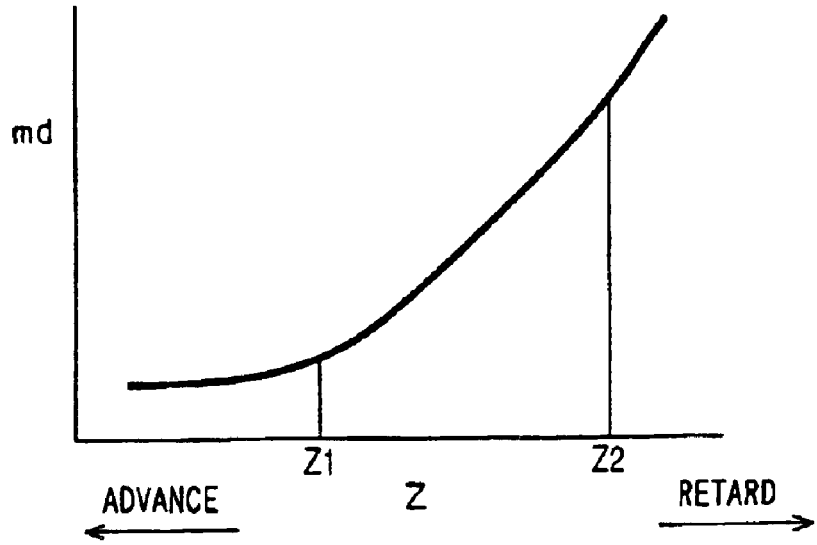
FIG. 7 is a graph showing a relationship between fuel injection timing and the particulate matter discharge quantity in the low speed and light load operating area of the engine according to the embodiment.

As shown in FIG. 7, the PM discharge quantity md increases if the fuel injection timing Z is retarded. Therefore, the fuel injection timing is advanced from preset timing Z2 to another timing Z1 in order to limit the PM discharge quantity md.

EXAMPLE 5

Figure 8:
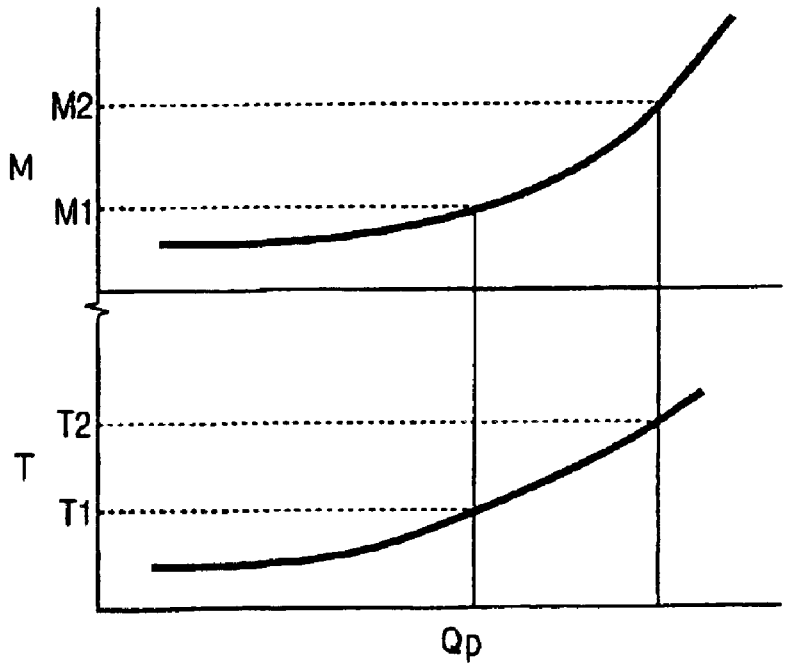
FIG. 8 is a graph showing relationships among a post injection quantity, fuel consumption and temperature of a diesel particulate filter having an oxidation catalyst in the low speed and light load operating area of the engine according to the embodiment.

In addition to the operations in the examples 1 to 4, an operation for increasing the temperature T of the DPF 3 to a certain temperature T1 (for instance, 400° C.), which is lower than the temperature T2 (for instance, 500° C.) as a preset value of the temperature increasing operation in the area B, may be performed as shown in FIG. 8. In this operation, the DPF temperature increasing means performs the post injection to increase the temperature of the DPF 3. Thus, the increase in the PM accumulation quantity m in the DPF 3 is inhibited more effectively by gradually combusting the particulate matters. Thus, the fuel consumption M can be reduced from a preset quantity M2 to another quantity M1, as the temperature T of the DPF 3 is decreased from the preset temperature T2 to the temperature T1 as shown in FIG. 8. As a result, the post injection quantity Qp is decreased. Thus, the effect of limiting the PM accumulation quantity m can be improved while inhibiting the degradation of the fuel consumption.

Figure 9:
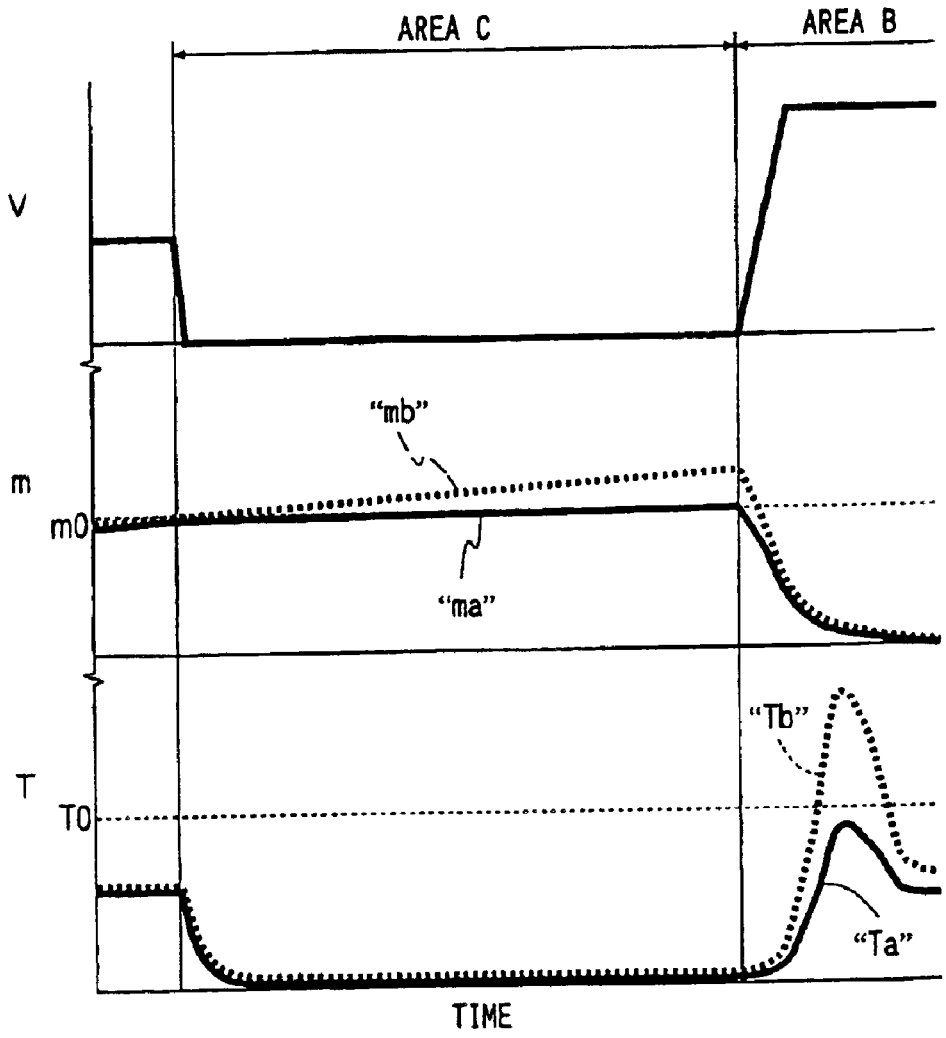
FIG. 9 is a time chart showing an effect of the exhaust cleaning system according to the embodiment while a vehicle is traveling.

FIG. 9 is a time chart showing the effect of the present invention while the vehicle is traveling. In FIG. 9, V represents velocity of the vehicle. In the technology of the related art having no PM accumulation inhibiting means, the regeneration of the DPF 3 and the like are not performed when the engine operating condition enters the area C in the state in which the PM accumulation quantity m reaches m0, at which the regeneration of the DPF 3 is required as shown in FIG. 9. Therefore, the PM accumulation quantity m increases further as shown by a broken line "mb" in FIG. 9. If the operating condition enters the area B and the regeneration is performed afterward, the temperature T of the DPF will be increased extremely as shown by a broken line "Tb" in FIG. 9. As a result, the temperature T of the DPF will exceed a heat resistance limit temperature T0.

On the contrary, in the present invention, when the engine 1 is operated in the area C, the PM discharge quantity md is reduced or the particulate matters in the DPF 3 are combusted gradually. Thus, the PM accumulation quantity m does not increase virtually as shown by a solid line "ma" in FIG. 9. Accordingly, when the vehicle travels under the condition in the area B afterward, the temperature T of the DPF 3 does not exceed the heat resistance limit temperature T0 as shown by a solid line "Ta" in FIG. 9. As a result, the DPF 3 can be regenerated safely.

The present invention should not be limited to the disclosed embodiment, but may be implemented in many other ways without departing from the spirit of the invention.

What is claimed is:

1. An exhaust gas cleaning system for an internal combustion engine, the exhaust gas cleaning system comprising:

a particulate filter disposed in an exhaust passage of the engine for collecting and accumulating particulate matters included in exhaust gas;

an operating condition detecting means for detecting an operating condition of the engine;

particulate matter accumulation quantity detecting means for detecting a quantity of the particulate matters accumulated in the particulate filter;

temperature increasing means for increasing temperature of the particulate filter;

temperature increase controlling means for operating the temperature increasing means based on detection results of the operating condition detecting means and the particulate matter accumulation quantity detecting means; and particulate matter accumulation inhibiting means included in the temperature increase controlling means for performing an operation for inhibiting the accumulation of the particulate matters to the particulate filter when the particulate matters accumulated in the particulate filter exceeds a predetermined quantity and the engine is under a predetermined operating condition;

wherein the temperature increase controlling means stops temperature increasing operation performed with the temperature increasing means if an output torque of the engine is equal to or greater than a first threshold in the case where the quantity of the accumulated particulate matters exceeds the predetermined quantity, wherein the temperature increase controlling means performs the temperature increasing operation with the temperature increasing means if the output torque of the engine is less than the first threshold and is equal to or greater than a second threshold, which is less than the first threshold, in the case where the quantity of the accumulated particulate matters exceeds the predetermined quantity, and wherein the temperature increase controlling means performs an operation with the particulate matter accumulation inhibiting means if the output torque of the engine is less than the second threshold in the case where the quantity of the accumulated particulate matters exceeds the predetermined quantity, without performing the temperature increasing operation with the temperature increasing means.

2. The exhaust gas cleaning system as in claim 1, wherein the first and second thresholds are determined in accordance with rotation speed of the engine.

3. The exhaust gas cleaning system as in claim 1, wherein the temperature increase controlling means includes determining means for determining whether duration of the operating condition of the engine in the state where the quantity of the accumulated particulate matters is greater than the predetermined quantity and the output torque of the engine is lower than the second threshold is longer than a predetermined period, and the temperature increase controlling means performs the operation with the particulate matter accumulation inhibiting means only when the determining means determines affirmatively.

4. The exhaust gas cleaning system as in claim 1, wherein the particulate matter accumulation inhibiting means performs an operation for reducing a quantity of the particulate matters discharged from the engine.

5. The exhaust gas cleaning system as in claim 4, wherein the particulate matter accumulation inhibiting means reduces the quantity of the particulate matters discharged from the engine by reducing a quantity of exhaust gas recirculated into intake air.

6. The exhaust gas cleaning system as in claim 4, wherein the particulate matter accumulation inhibiting means reduces the quantity of the particulate matters discharged from the engine by decreasing an upper limit guard value of fuel injection quantity with respect to air intake quantity, the upper limit guard value being set in order to inhibit the discharge of the particulate matters.

7. The exhaust gas cleaning system as in claim 4, wherein the particulate matter accumulation inhibiting means reduces the quantity of the particulate matters discharged from the engine by increasing fuel injection pressure.

8. The exhaust gas cleaning system as in claim 4, wherein the particulate matter accumulation inhibiting means reduces the quantity of the particulate matters discharged from the engine by advancing fuel injection timing.

9. The exhaust gas cleaning system as in claim 1, wherein the particulate matter accumulation inhibiting means includes means for inhibiting an increase in the quantity of the particulate matters accumulated in the particulate filter by gradually combusting the accumulated particulate matters.

10. A method for cleaning exhaust gas from an internal combustion engine, the method comprising:

disposing a particulate filter in an exhaust passage of the engine for collecting and accumulating particulate matters included in exhaust gas;

detecting an operating condition of the engine;

detecting a quantity of the particulate matters accumulated in the particulate filter;

increasing the temperature of the particulate filter based on results of the detecting steps; and inhibiting the accumulation of particulate matters to the particulate filter when the particulate matters accumulated in the particulate filter exceeds a predetermined quantity and the engine is under a predetermined operating condition;

stopping temperature increase of the particulate filter if an output torque of the engine is equal to or greater than a first threshold in the case where the quantity of the accumulated particulate matters exceeds the predetermined quantity, increasing the temperature of the particular filter if the output torque of the engine is less than the first threshold and is equal to or greater than a second threshold, which is less than the first threshold, in the case where the quantity of the accumulated particulate matters exceeds the predetermined quantity, and not increasing the temperature of the particulate filter if the output torque of the engine is less than the second threshold in the case where the quantity of the accumulated particulate matters exceeds the predetermined quantity.

11. A method as in claim 10 wherein the first and second thresholds are determined in accordance with rotation speed of the engine.

12. A method as in claim 10 wherein;

temperature increase of the particulate filter is controlled by determining whether duration of the operating condition of the engine in the state where the quantity of the accumulated particulate matters is greater than the predetermined quantity and the output torque of the engine is lower than the second threshold is longer than a predetermined period.

13. A method as in claim 10 wherein:

a quantity of the particulate matters discharged from the engine is reduced by said inhibiting step.

14. A method as in claim 13 wherein:

the quantity of the particulate matters discharged from the engine is reduced by reducing a quantity of exhaust gas recirculated into intake air.

15. A method as in claim 13 wherein:

the quantity of the particulate matters discharged from the engine is reduced by decreasing an upper limit guard value of fuel injection quantity with respect to air intake quantity, the upper limit guard value being set in order to inhibit the discharge of the particulate matters.

16. A method as in claim 13 wherein:

the quantity of the particulate matters discharged from the engine is reduced by increasing fuel injection pressure.

17. A method as in claim 13 wherein:

the quantity of the particulate matters discharged from the engine is reduced by advancing fuel injection timing.

18. A method as in claim 10 wherein:

an increase in the quantity of the particulate matters accumulated in the particulate filter is inhibited by gradually combusting the accumulated particulate matters.

* * * * *